United States Patent [19]

Morganroth

[11] Patent Number: 4,506,783

[45] **Date of Patent: * Mar. 26, 1985**

[54] HAIR BLEACHING ART

[76] Inventor: Shila Morganroth, 1225 Waterbury Rd., Highland, Mich. 48031

[ * ] Notice: The portion of the term of this patent subsequent to Sep. 26, 1995 has been disclaimed.

[21] Appl. No.: 104,106

[22] Filed: Dec. 17, 1979

Related U.S. Application Data

[60] Continuation of Ser. No. 688,595, Jul. 9, 1976, abandoned, which is a division of Ser. No. 579,012, May 9, 1975, Pat. No. 4,114,632, and a continuation-in-part of Ser. No. 481,695, Jun. 14, 1974, Pat. No. 4,209,207.

[51] Int. Cl.[3] ..... B65D 35/44

[52] U.S. Cl. ..... 206/581; 132/7; 222/92; 206/221

[58] Field of Search ..... 206/221, 581; 132/7, 132/11 R

[56] References Cited

U.S. PATENT DOCUMENTS

| | | | |
|---|---|---|---|
| 2,729,328 | 1/1956 | Van Rossen | 206/63.5 |
| 2,800,269 | 7/1957 | Smith | 220/221 |
| 2,828,858 | 4/1958 | Tooke | 220/221 |
| 3,187,757 | 6/1965 | Jones | 220/400 |
| 3,240,567 | 3/1966 | Caparreli | 206/0.5 |
| 3,258,017 | 6/1966 | Albert | 220/229 |
| 3,297,152 | 1/1967 | Corella | 220/221 |
| 3,528,921 | 9/1970 | Gray | 206/0.5 |
| 3,819,107 | 6/1974 | Ryder | 206/219 |
| 4,116,365 | 9/1978 | Morganroth | 132/7 |

*Primary Examiner*—George E. Lowrance
*Attorney, Agent, or Firm*—George H. Mortimer

[57] ABSTRACT

Improvements in the art of hair bleaching relating particularly to packaging of and packages for bleach materials in dry, powdered form contained in unit quantity enclosed within a flexible plastic bag which itself is enclosed within a moisture proof can. The can may be large enough only for one such bag of powdered bleach or large enough for a plurality of such bags. Auxiliary materials such as liquid developer to be united by manipulation of the bag with the powder to form a paste, a cap for the head, gloves for the hands, etc., may be included within the package. The bag is preferably provided with an opening through which the developer may be introduced and the paste discharged, and it may be surrounded by a ring that is threaded to receive a threaded cap to close the opening to make the bag dust-proof during storage of the powder and manipulation to make paste. The cap may have a tip with a discharge passageway through which the contents of the bag may be discharged, e.g., a movable tip pivoted to the cap that serves in one position to close the passageway and in another position to open it. The tip may be shaped to enable direct application of the paste to the hair as it is discharged. Spreading of the paste on the hair may be assisted by a brush on the cap adjacent to the opening.

1 Claim, 6 Drawing Figures

FIG. 1
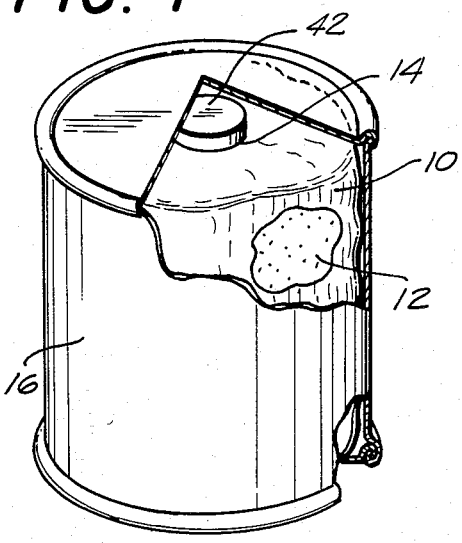
FIG. 5
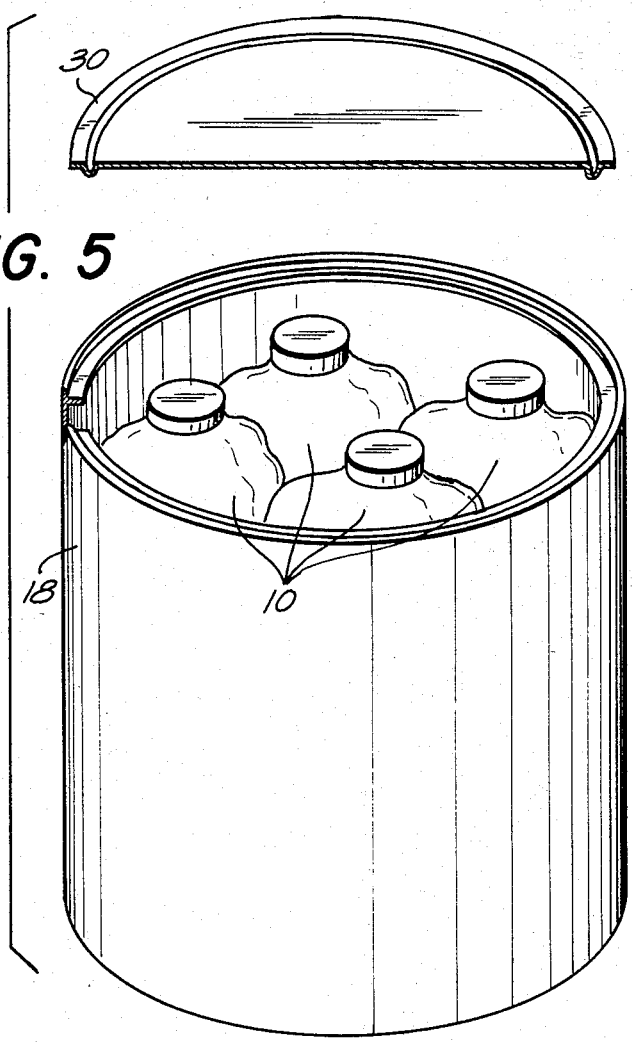
FIG. 2
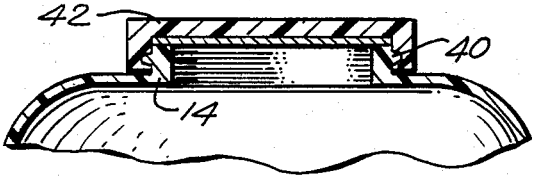
FIG. 3
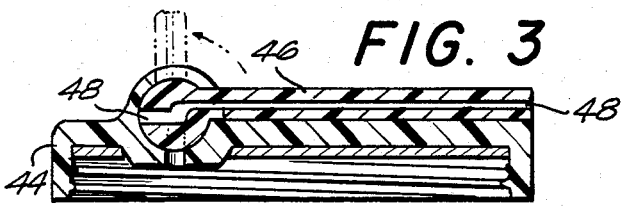
FIG. 4
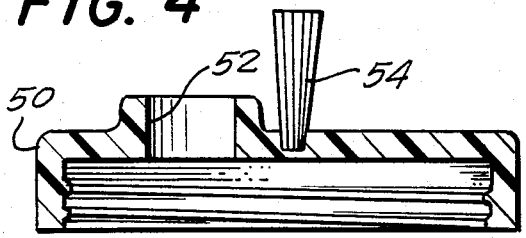
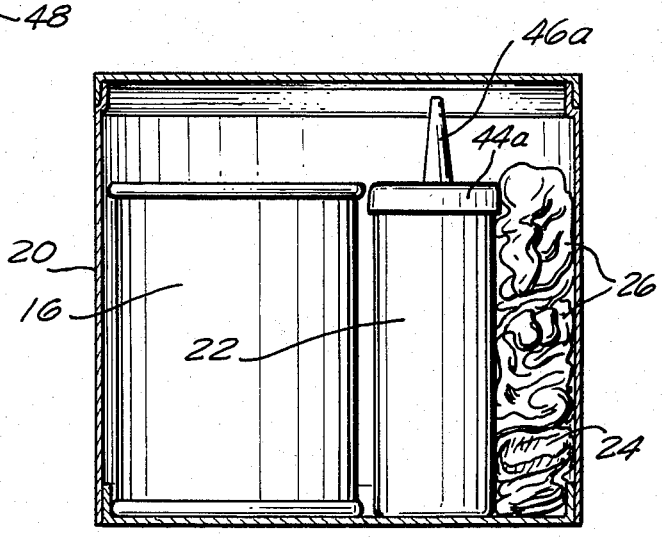
FIG. 6

HAIR BLEACHING ART

INTRODUCTION

This application is a continuation of my prior application Ser. No. 688,595, filed July 9, 1976, abandoned, which was a division of Ser. No. 579,012, filed May 9, 1975, now U.S. Pat. No. 4,114,632 granted Sept. 19, 1978, and as a continuation-in-part of Ser. No. 481,695, filed June 14, 1974, now U.S. Pat. No. 4,209,207 granted June 24, 1980.

The present invention relates to improvements in the art of bleaching hair in which the improvement relates particularly to packaging of and packages for hair bleach materials specifically adapted for use in methods of altering hair color selectively. Methods in which such packages are intended to be used include hair highlighting, hair painting, hair streaking, hair frosting, hair tipping and the like, all of which are included within the term "hair bleaching operation," with a highly viscous or pasty hair bleach material as more fully described in my said prior applications, of which Ser. No. 579,012, issued as U.S. Pat. No. 4,114,632 on Sept. 9, 1978.

The word "liquid" as used herein is intended to be broad enough to include any spreadable material even if it will not flow readily because of its high viscosity. The packages are designed to provide in one container all the materials needed for carrying out a hair treatment by a particular operation or method.

BACKGROUND OF THE INVENTION

Powdered hair bleach materials are known in the hair coloring art which, when mixed with a developer such as hydrogen peroxide of various strengths or "volumes," can be applied to the hair to lighten its color. The mixture of the powder and liquid is prepared in various consistencies for application to the hair as an "off-the-scalp" type bleach. It is so called because many persons have skin that is irritated by contact with the bleach material. Because of the nature and properties of powdered hair bleach materials, such as BASIC WHITE, special packaging for intended uses have been customarily used.

BASIC WHITE, for example, is a very fine powdered material that is hygroscopic and therefore must be protected against humidity in the atmosphere during storage. It requires the admixture with it of a developer, generally a peroxide solution, in order to form a mixture having a suitable consistency for spreading on the hair by a brush or the like in well-known manner.

One current practice, as exemplified by a kit for frosting or tipping a woman's hair, is to produce and seal a carton containing a bowl or mixing vessel, an air-tight can of BASIC WHITE, a plastic squeeze bottle containing the developer and having a moisture-tight cap screwed on the neck thereof, a spoon or the like to serve as the mixing implement when the powder and the developer are mixed together in the open bowl, a perforated cap, two plastic hooks and a sheet of instructions with a double sheet of plastic adhering to the back side in which a pair of gloves is formed by heat sealing the periphery and weakening the sheet around them so that the gloves can be pulled loose to wear during application of the mixture of the BASIC WHITE and developer to the hair pulled through the perforations in the cap. The instructions warn against inhaling the obnoxious cloud of powder which inevitably rises from the mixing bowl when the can is emptied into it and when the powder is first stirred to blend it with the liquid developer.

In another current practice for beauty shop use BASIC WHITE is sold in much larger quantity than needed for a single hair treatment such as a bleaching operation. This large quantity is placed in a plastic bag inside a can that may be opened and closed to minimize contact of the atmosphere with the BASIC WHITE until it has all been used up by removing successive unit quantities. The problem of dust in the air attends the use of the powder when packages in this way also.

DESCRIPTION OF THE INVENTION

The present invention will now be described in conjunction with the drawings illustrating a number of specific embodiments thereof in which FIG. 1 is a perspective view of one embodiment of an outer moisture proof container such as a can and the like partially broken away to show one thin walled, moisture-resistant plastic bag within it which in turn is broken way to show bleach powder enclosed therein, the bag being provided with an access opening and means to open it to admit liquid and close it to make it dust-proof;

FIG. 2 is a fragmentary sectional view on a larger scale of the portion of the bag in which the opening is formed showing one embodiment of threaded ring and cap to serve as the opening and closing means;

FIG. 3 is a sectional view of another embodiment of threaded cap for use with a bag such as shown in FIG. 2;

FIG. 4 is a sectional view of a further form of cap for use with a bag such as shown in FIG. 2 which is adapted for discharging bleach paste directly onto hair and for spreading it, e.g., to form streaks;

FIG. 5 is an exploded perspective view on a smaller scale of another embodiment of an outer moisture-proof container such as a press lid can with lid removed and in section to reveal a plurality of thin, moisture resistant plastic bags therein of the type shown in FIGS. 1 and 2; and FIG. 6 is a sectional view of a package containing a container of bleaching powder such as shown in FIG. 1, a container such as a squeeze bottle and closure cap for liquid to be mixed with the bleach powder and auxiliary devices for use in applying the paste to the hair.

DESCRIPTION OF SPECIFIC EMBODIMENTS OF THE INVENTION

The present invention overcomes the aforementioned difficulties of the prior art by providing a thin walled, flexible, moisture-resistant plastic container 10 in which the bleach powder 12 is packaged or enclosed in unit quantity, i.e., just sufficient for a single application for the purpose for which the package is intended, e.g., a hair bleaching operation. This plastic container has a passageway or opening 14 through the wall thereof large enough to admit the introduction of the liquid to be mixed with the powder and also large enough for discharge of the viscous or pasty product resulting from the mixing of the powder and the liquid developer. The plastic bag, after receiving its charge of BASIC WHITE powder, may be closed in any desired way to avoid spillage of the powder in normal handling between filling and use, i.e., it is made dust-proof. It is placed within a can or like moisture-proof container which may be of either type pesently used for shipping BASIC WHITE described above, i.e., of the single-use type 16 for home use and the multiple-use type 18 for beauty salons. The present invention contemplates packages comprising cans of both types, i.e., a smaller type containing the single charge of powder in the plastic bag and a larger type containing many such bags which may be removed one at a time for use in a beauty salon.

A package for a single use preferably comprises a carton 20, which may be of the conventional tube type with tuck-in end flaps, a can 16 containing the powdered bleach 12, e.g., BASIC WHITE, in a plastic bag 10, a bottle 22 of developer and optionally a cap 24, gloves 26 and instructions (not illustrated); but it is not necessary to include the other implements normally contained within such a package, e.g., the mixing spoon and the mixing bowl.

A package for multiple use comprises a can 18 with a tight lid 30, e.g., a press-type lid, that can be lifted out with a lever to make the contents available for removal for use and then pressed back in the opening to minimize free contact of the atmosphere with the interior. In the can 18 are many bags 10 of the structure described herein, each containing a unit quantity of the hair bleaching powder. Developer may be separately packaged in single or multiple use containers.

If desired, the flexible-walled plastic bag used in the package of the invention may have a reinforcing ring 40 secured thereto around the opening 14 so as to make access to the bag for removal of paste, e.g., by a paste-spreading brush, easier than if the opening is simply a hole in the wall of the bag. Also such a ring 40 may be threaded to receive selectively (a) a simple closure cap 42, (b) a cap 44 that may be opened and closed by a pivoted tip 46 having a discharge passageway 48 through it, or (c) a cap 50 having a discharge orifice 52. The discharge passageway 48 and orifice 52 in caps of type (b) and (c) are of a size permitting removal of paste from the bag, e.g., as a stream of ribbon of BASIC WHITE paste dispensed through them when pressure is exerted on the bag 10 directly onto the hair for hair painting, streaking, frosting, tipping and the like. The caps of types (b) and (c) may include a brush 54 adjacent to the discharge orifice to assist in painting the paste on the hair. When a dispensing cap of type (c) is used, the bag is preferably closed for transportation by a simple closure cap such as 42 and the threaded dispensing fixture or cap is included in the package to replace the closure cap for dispensing the paste. Just prior to use of the unit quantity of powder in a plastic bag of any of these types, the developer from any source, e.g., squeeze bottle 22, is introduced through the opening 14 in the wall thereof into the bag where the powder is contained, e.g., by snipping off the closed end of tip 46*a* on cap 44*a* of bottle 22 which does not create any dust problem whatsoever. The opening is then closed in any satisfactory way, e.g., by twisting the upper end of the bag, by use of a closure cap 42 or a valve cap 44, or by use of a cap 50 with an open discharge orifice 52 that is closed by a finger of the hand of the person who is mixing the ingredients, etc., while the contents of the bag are manipulated so as to effect thorough mixing. Since the mixing takes place in an air tight environment, no dust problem, spillage or the like occurs during the mixing and every bit of the original powder in the bag may be properly admixed with the developer. After manipulating the flexible-walled package sufficiently to effect thorough mixing, the pasty product produced in the mixing operation can be removed, e.g., by being taken out of or expelled from the plastic bag, for use in any desired way, e.g., for spreading on the palms of the hands to produce natural highlights, as described in my aforesaid parent application, Ser. No. 579,012, or by putting it in a squeeze bottle, e.g., bottle 22, for dispensing through the tip as disclosed in my aforesaid parent application Ser. No. 481,695, or it may be removed on a brush for applying to the hair to affect streaking, or it may be squeezed from the bag through the discharge orifice directly onto the hair for painting or into a bowl for any use to which such paste has been put heretofore.

The foregoing specific examples of the packages and methods of using them according to the invention are illustrative of the principles of the invention set forth hereinabove and in the following claims and are not to be construed as restricting the scope of the invention to the specific structure of the illustrative embodiment.

Having thus described and illustrated the invention, what is claimed is:

1. In the art of bleaching hair with a viscous mixture of liquid developer and finely powdered, duating, obnoxious powder, the improvement which comprises (a) producing a package by (i) enclosing the quantity of said hair bleaching powder required for a single hair bleaching operation in a dust-proof, moisture-resistant, thin-walled, flexible plastic bag and (ii) enclosing said bag in a moisture-proof container;

(b) removing said bag from said container;

(c) introducing liquid into said powder within said bag in proper quantity to form a paste of desired viscosity;

(d) mixing said liquid and powder by manipulating said bag to form said paste;

(e) removing paste from said bag; and (f) applying said paste to the hair to be bleached.

* * * * *